US005954182A

United States Patent [19]

Wei

[11] Patent Number: 5,954,182

[45] **Date of Patent: *Sep. 21, 1999**

[54] COIN RECEIVING MECHANISM HAVING FOREIGN OBJECT RELEASE DEVICE

[75] Inventor: Wenquan Wei, San Francisco, Calif.

[73] Assignee: Tatung Telecom Corporation, Mountain View, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 08/739,797

[22] Filed: Oct. 30, 1996

[51] Int. Cl.[6] ..... G07F 1/04

[52] U.S. Cl. ..... 194/345; 194/349

[58] Field of Search ..... 194/321, 323, 194/345, 346, 347, 348, 349, 351

[56] References Cited

U.S. PATENT DOCUMENTS

| | | | |
|---|---|---|---|
| 4,660,706 | 4/1987 | Wollet | 194/351 |
| 4,687,090 | 8/1987 | Ramseier | 194/317 |
| 5,090,548 | 2/1992 | Hird et al. | 194/345 |
| 5,255,770 | 10/1993 | Hird et al. | 194/345 |
| 5,299,673 | 4/1994 | Wu | 194/345 |

FOREIGN PATENT DOCUMENTS

| | | | |
|---|---|---|---|
| 3538717A1 | 5/1987 | Germany | G07F 1/02 |
| 2-76094 | 3/1990 | Japan | G07F 9/10 |
| 1334157 | 5/1991 | United Kingdom | 194/345 |

OTHER PUBLICATIONS

Two sheets of engineering drawings (Figs. 9 and 10) by: E. Wu and Wenquan Wei, Tatung Telecom Corporation.

*Primary Examiner*—F. J. Bartuska
*Attorney, Agent, or Firm*—Ladas & Parry

[57] ABSTRACT

An improved coin receiving mechanism having a foreign object release device. The invention includes first and second chute walls having spaced apart inner surfaces which are substantially parallel to each other when the mechanism is in an unactivated state. The inner surfaces define the walls of a coin chute path through which a coin travels. The first and second chute walls each further have an upper chute wall portion, disposed adjacent an entrance to the coin chute path, and a lower chute wall portion, disposed adjacent to and in communicating relationship with an exit of the coin chute path. The first and second coin chute walls are hingedly mounted to a frame. The invention also includes provisions for moving the coin chute walls from the unactivated state to an activated state wherein the coin chute walls are first pivoted together until the lower chute portions of each of the first and second chute walls are no longer disposed in communicating relationship with the exit of the coin chute path. The coin chute walls are then pivoted separately with the coin chute wall which is further from the exit being pivoted to a greater extent so that the coin chute walls open to eject foreign objects caught between the coin chute walls and thereby clear the coin chute path while restricting the objects from falling into the exit.

5 Claims, 6 Drawing Sheets

COIN RECEIVING MECHANISM HAVING FOREIGN OBJECT RELEASE DEVICE

BACKGROUND OF THE INVENTION

1. Field of the Invention

The invention described below relates to a coin receiving mechanism for use with coin or token activated machines such as, for example, vending machines and coin changing machines. The invention is particularly useful in pay telephones.

2. Description of the Prior Art

A major problem associated with coin receiving mechanisms used in pay telephones, vending machines, change machines and the like is their susceptibility to being intentionally jammed by a thief intent on stealing subsequently deposited coins. The thief stuffs paper, cloth, or other foreign objects into the coin deposit chute which blocks the coin acceptor/counter device associated with a coin receiving mechanism. After setting his trap, the thief waits until one or more paying customers have deposited coins in the coin deposit chute blocked by the foreign objects. Since the deposited coins are blocked by the foreign objects, these coins cannot be retrieved by operating the coin release lever or tapping on the coin activated machine. After the paying customer leaves, the thief returns to complete the theft by attempting to fish out the coins stuck in the coin deposit chute with a wire, comb or other instrument. In fishing out the coins, the thief often will cause further jamming and/or damage to the coin receiving mechanism and the coin acceptor/counter device. Typically, the thief will leave the foreign objects in the coin receiving mechanism, resulting in an ongoing loss of sales from the machine and requiring repair personnel to make a service call to remove the blockage. Such illegal activity not only inconveniences and upsets honest customers of the coin operated machine, but also results in substantial economic loss to the owners and operators of coin operated machines by way of loss sales and higher repair costs.

Several attempts have been made to overcome the above identified problem, but most have met with limited success. U.S. Pat. No. 4,660,706 (issued to Wollet) teaches a mechanism with a metal plate which blocks the coin deposit slot of the coin activated machine if foreign objects are stuffed between the wall of the coin chute, and thereby prevents the additional foreign objects and/or coins from being deposited. However, the Wollet device does not provide any feature which would allow the customer to clear the blockage. With the Wollet device, once the coin chute is stuffed with foreign objects, a metal plate shuts the coin deposit slot of the coin activated machine, thereby blocking further access to the coin deposit chute and rendering the coin activated machine inoperative. Although later customers are prevented from losing their coins to thieves, sales are lost until service personnel make a service call to clear the machine.

U.S. Pat. No. 4,687,090 (issued to Ramseier) discloses a coin receiving mechanism having separable coin guide walls which define a coin track having sections arranged in a zigzag form. While the Ramseier device purportedly has a feature to allow unblocking of the coin chute path, one of the walls, which is set at a steep angle to the vertical, does not move and thus it cannot "kick" debris out of the coin path. Thus, the Ramseier device can require at least several operations to clear paper jams.

A very successful attempt to overcome the problem created by foreign objects being jammed into the coin chute is described in U.S. Pat. No. 5,299,673 issued to Wu (hereinafter the '673 patent). The present invention is an improvement of the coin receiving mechanism having a foreign object release device disclosed in the '673 patent, and the entire specification and drawings of the '673 patent are incorporated herein by reference.

The device disclosed in the '673 patent includes separable coin chute walls defining a coin chute path, which when separated by turning the coin return lever on the coin operated device, for example, cause objects lodged between the coin chute walls to be ejected, thereby clearing foreign objects from the coin chute path and the coin acceptor/counter device.

When the coin chute path of the device disclosed in the '673 patent is stuffed with paper or other foreign objects, thereby blocking the coin chute path through which a coin normally travels, the coin activated machine will not operate. The paying customer will invariably turn the coin return lever on the coin activated machine, thereby separating the coin chute walls and ejecting the foreign objects to clear the coin chute path. Turning the coin return lever turns a drive arm, which then rotates a cam member coupled to the two walls of the coin chute by drive arms, causing the walls to separate at their bottom portion. One of the walls swings out wider than the other, thereby flipping and ejecting any foreign objects and coins previously jammed therebetween into a waste receiver. Thereafter, when the coin release lever is released, the two walls of the coin chute spring back to their inactivated position of being parallel in a vertical plane, free from any blockage and immediately available for use. The coin release mechanism of the '673 patent may also include a coin shutter with a coin slot passing therethrough. The coin shutter moves to block the coin accepting slot on the outside of the machine when the coin release lever is activated and/or the walls of the coin chute are spread apart because of the presence of foreign objects or tools inserted therebetween, thereby preventing further jamming of foreign articles therein and further loss of coins by a paying customer.

In a preferred embodiment of the device of the '673 patent, the walls of the coin chute path are manufactured with several planar sections, each arranged in a zig-zagged orientation in one direction with respect to each other. At least one planar section is arranged at an angle offset from the direction of the zig-zagged sections. This zig-zagged and turned arrangement of planar sections helps prevent a wire or other instrument from being inserted very far down into the coin path defined by the walls. The inside of the wall sections preferably have parallel grooves and ribs defined thereon in the same direction of coin travel. These grooves and ribs help prevent wet coins from sticking in the coin chute path, and also help prevent a wire or other instrument from being inserted into the mechanism and negotiated through the space between the zigzagged and angled wall sections, to the end of the sections. Groups of groove blocks are preferably located at various positions in the grooves between the ribs on the inside of the coin chute walls, which groove blocks help to catch on inserted wires or tools, thereby further frustrating attempts by the thief to push foreign objects into the coin chute path.

SUMMARY OF THE INVENTION

The invention is an improved coin receiving mechanism having a foreign object release device for use with a coin receiving machine. The invention includes first and second chute walls having spaced apart inner surfaces which are substantially parallel to each other when said mechanism is in an unactivated state. The inner surfaces define left and right walls of a coin chute path through which a coin travels. The first and second chute walls each further have an upper chute wall portion and a lower chute wall portion, wherein the upper chute wall portion is disposed adjacent an entrance to the coin chute path and wherein said lower chute wall portion is disposed adjacent to and in communicating relationship with an exit of the coin chute path. The first and second coin chute walls are hingedly mounted to a frame. The invention also includes a a wall moving a means for moving the coin chute walls from the unactivated state to an activated state wherein the coin chute walls are first pivoted together until the lower chute portions of each of the first and second chute walls are no longer disposed in communicating relationship with the exit of the coin chute path. The coin chute walls are then pivoted separately with the coin chute wall which is further from the exit being pivoted to a greater extent so that the coin chute walls open to eject foreign objects caught between the coin chute walls and thereby clear said coin chute path while restricting said objects from falling into said exit.

DETAILED DESCRIPTION OF THE INVENTION

Figure 1:
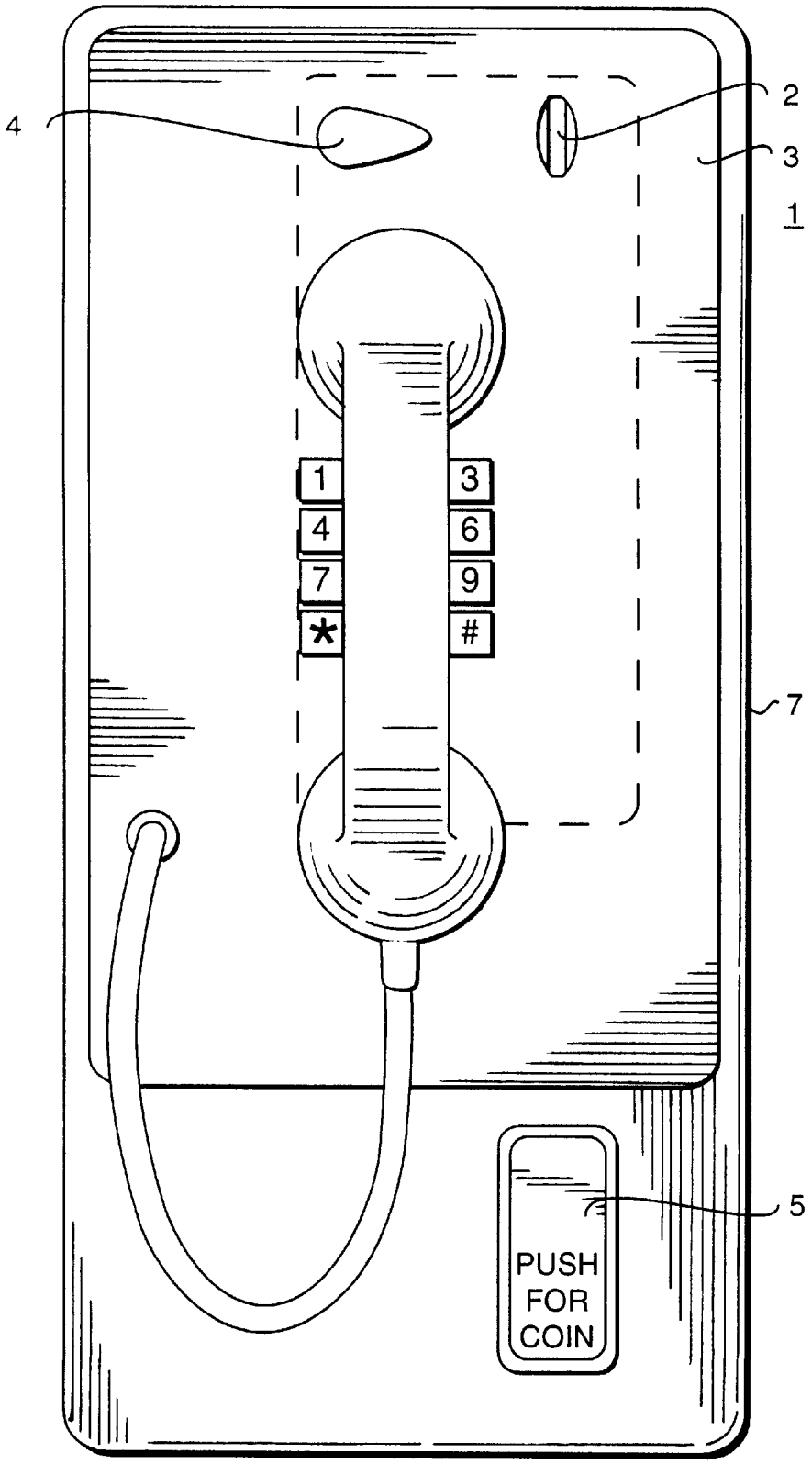
FIG. 1 is a front view of a coin operated telephone with the location of the improved coin receiving mechanism having a foreign object release device outlined by dashed lines.

As discussed above, the present invention is an improvement of the coin receiving mechanism disclosed in U.S. Pat. No. 5,299,673, the specification and drawings of which are incorporated herein by reference. The description below pertains to the improvement which is embodied in the present invention.

The preferred embodiment of the present invention is illustrated in the attached drawings which are referred to herein. The same reference numeral will be used to identify identical elements throughout the drawings.

For sake of convenience, the mechanism is shown and discussed as used in a coin operated telephone, but the mechanism is equally applicable to other coin operated machines.

Referring to FIG. 1, the front of a coin operated telephone 1 is shown. The telephone has a coin slot 2 which passes through the front panel 3 of the telephone. The coin return lever 4 is located on the front panel 3 of the telephone. The coin return door 5 is located at the bottom of the telephone panel 3 of the telephone. The coin activated mechanism having a foreign object release device is located behind the front panel 3 in the vicinity of the dotted lines. A case 7 houses the coin activated mechanism and the electronics associated with the telephone's communication facilities.

FIGS. 2–8 illustrate the invented improved coin receiving mechanism.

Figure 2:
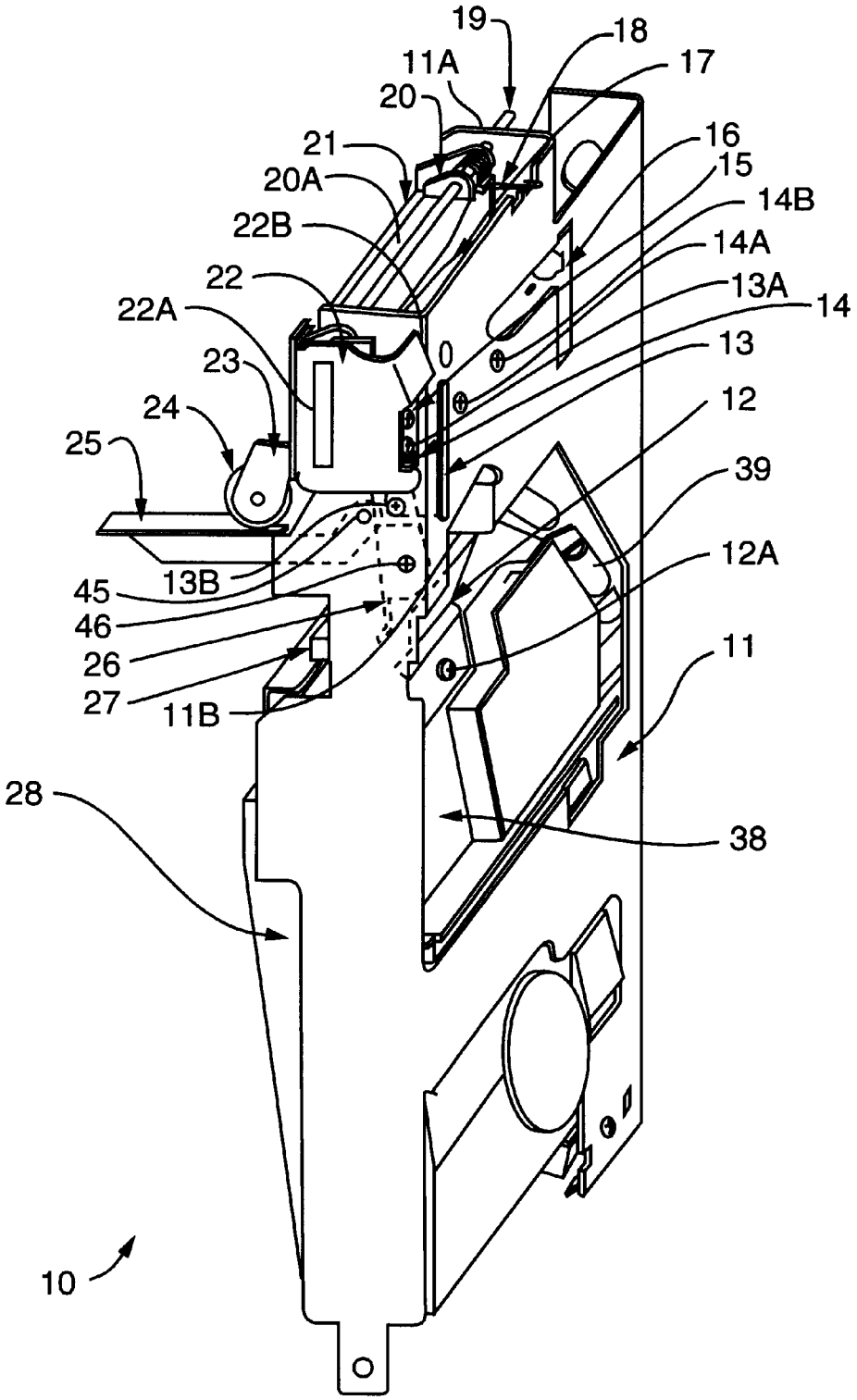
FIG. 2 is a perspective view of the improved coin receiving mechanism, as viewed from a position in front, to the right and above the improved coin receiving mechanism.

In FIG. 2, the front of the coin receiving mechanism is depicted as being closest to the newer, and terms such as left, right front and rear are all consistent with the drawing. In the preferred embodiment, it includes:

frame 11, right hopper or exit ramp 12 (which includes rear hopper or exit ramp 12A), which is fixedly attached to rear eject door 38 by screw 12A, rocker actuator 13, the upper end of which is fixedly attached to the front of the right chute wall by screw 13A, upper chute floor 14 (which includes ejector lip 44 and lower chute ceiling 34), which is fixedly attached to frame 11 by screws 14A and 14B, coin accepter/counter device 28 (of conventional design as embodied by model MS16 manufactured by Mars Electronics International), which is fixedly mounted to the lower portion of frame 11 and which has an eject door 38 hingedly attached to the main portion of the coin accepter at springed hinge 39, rear chute door 16 which is pivotally mounted in slots 41 and 42 formed in the frame and which is urged to pivot forward by coil spring 16A which has one end attached to the rear chute door and the other end attached to the frame, frame shaft 19 disposed in the upwardly extending superstructure 11A of frame 11, first or left win chute wall 21 pivotally disposed on frame shaft 19, second or right coin chute wall 20 pivotally disposed on the frame shaft 19, counterclockwise coil spring 18 disposed on frame shaft 19 with its front and rear end extensions contacting frame 11 and left chute wall 21 such that the left chute wall and the right chute wall are urged to pivot in a counterclockwise direction when viewed from the front, leaf spring 17 fixedly mounted on the right exterior surface of the right chute wall by means of a screw 13A passing through the upper portion of the rocker actuator and the leaf spring into the right chute wall, with the leaf springs free pushing against the frame 11 with sufficient force to urge the right coin chute wall to rotate in the clockwise direction when the left coin chute wall is moved out of abutting relationship with the right chute wall, shutter 22 with shutter slot 22A formed therein which is vertically aligned with coin slot 2 when the coin return lever is not activated and which is moved out of alignment with the coin slot when the coin return lever is activated, roller bracket 23 which, along with the shutter 22, is fixedly attached to the front end of the left chute wall, by screws 23A and 23B, roller 24 which is rotatably mounted on roller bracket 23, actuating lever 25 which is mechanically linked to the coin return lever 4 at one end and pivotally mounted on frame 11 at the other end at first short shaft 45, rocker 26 which, at approximately midpoint, is rotatably mounted on frame 11 at second short shaft 46, with its upper end pivotally engaged with the lower end of rocker actuator 13 at third short shaft 13B, which in turn in fixedly attached to the lower end of rocker actuator 13, and with the lower end of rocker 26 disposed a short distance away from right hopper ramp 12, and left hopper or exit ramp 27 which is fixedly attached to coin accepter/counter device 28 by screw 27A.

Many of the above-identified elements have one or more bends, so that a single element may lie in more than one plane. Also, the frame has several cut-outs or slots formed therein. Therefore, to aid the reader in identifying the foregoing elements, many reference numerals are disposed in several positions in the drawings.

Figure 3:
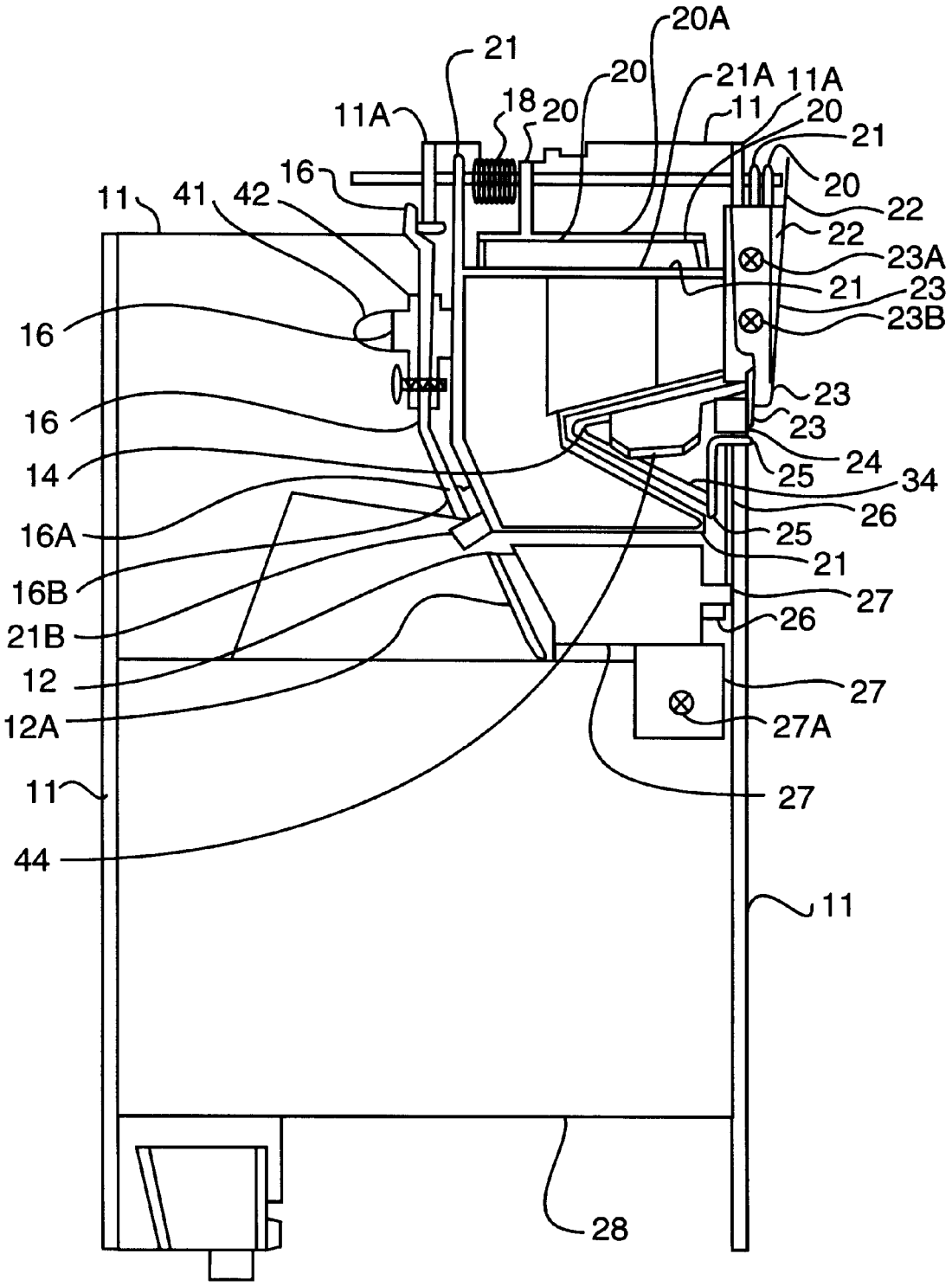
FIG. 3 is a left side elevational view of the improved coin receiving mechanism.
Figure 4:
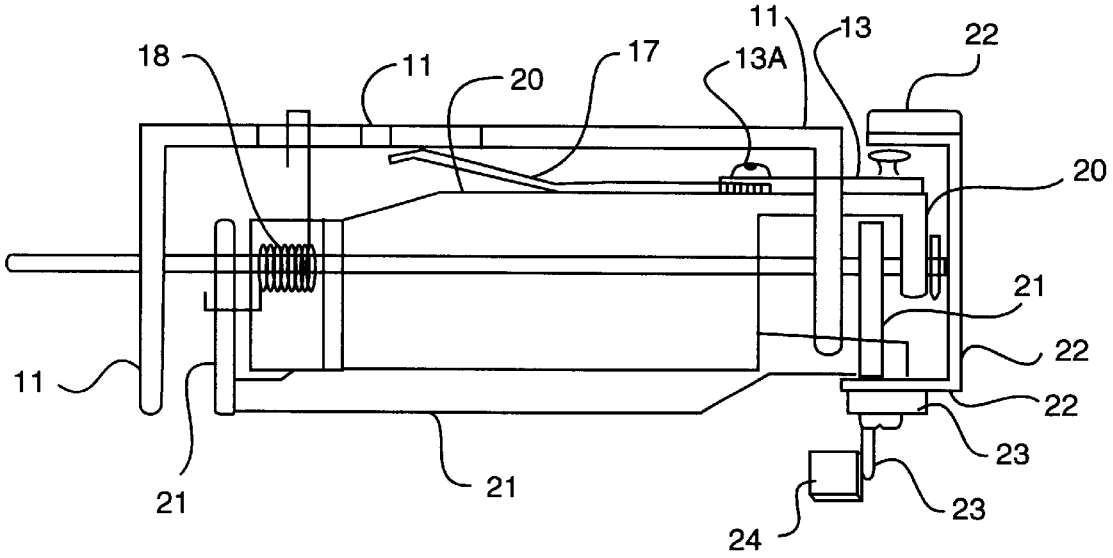
FIG. 4 is a partial top plan view of the improved coin receiving mechanism, showing the relationship between the mechanism's frame, the left and right coin chute walls, the return spring, the leaf spring, the roller bracket, the shutter, the rocker actuator, and the chute wall shaft.

FIGS. 2–4 show the elements of the improved coin receiving mechanism in their unactivated state.

In normal operation (i.e., when the coin return lever 4 is not actuated and no foreign material has been forced into the coin receiving mechanism), shutter slot 22A is in alignment with coin slot 2. A coin chute path is defined by the elements described below:

Shutter slot 22A forms the entrance of the coin chute path.

Figure 5:
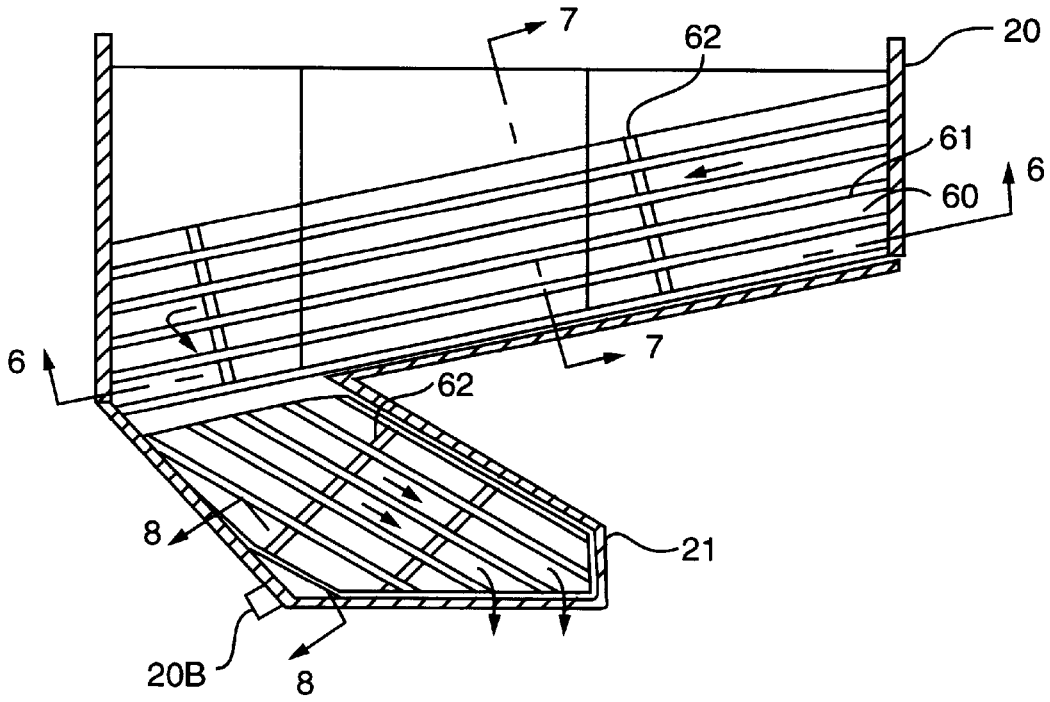
FIG. 5 is a partial side elevational view of the right coin chute wall.
Figure 6:
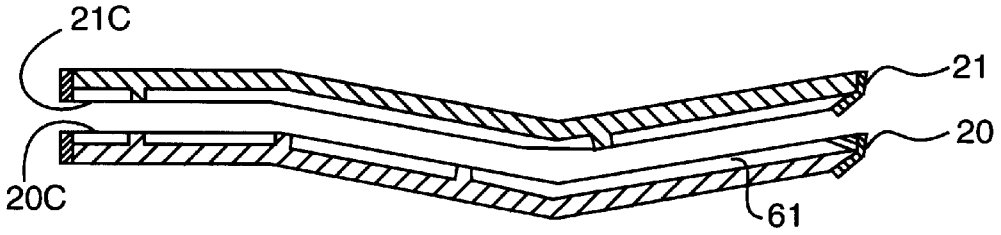
FIG. 6 is a partial bottom view of the coin chute wall taken along lines 6—6 of FIG. 5.

The inside surfaces of the right coin chute wall 20 and left coin chute wall 21 form the right and left walls, respectively, of the coin chute path. As described and shown in the '673 patent, these inside surfaces lie parallel to each other in a vertical position. As shown in FIGS. 5 and 6 of the drawings appended hereto, as the path moves from the front to the rear of the coin receiving mechanism, the inside surfaces of the chute walls zig-zag first to the left and then to the right. The path also tilts slightly downward the rear. After the path reaches its rear terminus, the path moves forward and more sharply downward.

The rear terminus of the coin chute path is defined by rear chute door 16. The lower portion of the rear chute door also defines the rear coin supporting ramp 16B for the lower portion of the path, which extends downward and forward from the path's rear terminus.

The floor of the upper portion of the coin chute path is defined by the upper portion of upper chute floor 14.

The ceiling of the upper portion of the coin chute path is defined by the right chute wall top 20A which extends inward to span over the open space between the inner surfaces of the left and right chute walls and to overlap over a portion of left wall top 21A.

The ceiling of the lower portion of the coin chute path is defined by the lower chute ceiling 34.

The exit of the coin chute path is defined by right hopper or exit ramp 12, rear hopper or exit ramp 12A, left hopper or exit ramp 27 and that portion of the frame immediately forward of the hopper elements.

Those of the foregoing elements which are movable are urged to remain in their normal positions by coil spring 18 which, as described above, urges the left and right chute walls to pivot in the counterclockwise direction, when viewed from the front until the right exterior surface of the right chute wall abuts against inwardly projecting abutment 11B of frame 11, and spring 16A which urges rear chute door 16 to pivot forward until the top portion of frame superstructure 11A. In normal operation, left and right chute walls are maintained in position such that their respective inner surfaces remain parallel and spaced apart from each other by a lip 51, shown in FIG. 8, which extends inwardly from left chute wall projection 21B, which extends rearward from the bottom, rear portion of the left chute wall, into an abutting relationship with a corresponding projection 20B of the right chute wall.

In normal operation, a coin inserted into coin slot 2 passes through shutter slot 22A and begins rolling downward and rearward atop upper chute floor 14. The coin will be turned slightly left, then right then left again as the coin contacts the inner surfaces of the upper portions of the right and left chute walls. If a coin is inserted into the coin slot with so much energy that it bounces within the coin chute path, the upward movement of the coin is limited by right chute wall top 20A.

After the coin rolls past the rear end of upper chute floor 14, the coin drops into the lower portion of the coin chute path. If a coin still has so much energy that it would fly past the opening to the lower portion of the coin chute path, the coin will bounce against the rear terminus of the coin chute path (i.e., rear chute door 16) and move back toward the lower portion of the coin chute path. Once the coin enters the lower portion of the coin chute path, it bounces or rolls on rear coin supporting ramp 16B and the lip extending inward from projections 21B, into the space defined by rear hopper ramp 12A, right and left hopper ramps 12 and 27, and the portion of the frame adjacent thereto (i.e., the exit or hopper area). If the coin still has so much energy that it would bounce up from the hopper area, lower chute ceiling 34 restricts upward movement of the coin so that it bounces back into the hopper area. The path travelled by a coin with respect to the coin chute walls is illustrated by the arrows in FIG. 5.

From the hopper area, the coin slides into the mouth of the coin accepter/counter device in the conventional fashion.

Figure 7:
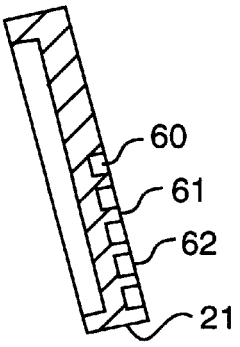
FIG. 7 is a partial cross-sectional view of the right coin chute wall taken along lines 7—7 of FIG. 5.
Figure 8:
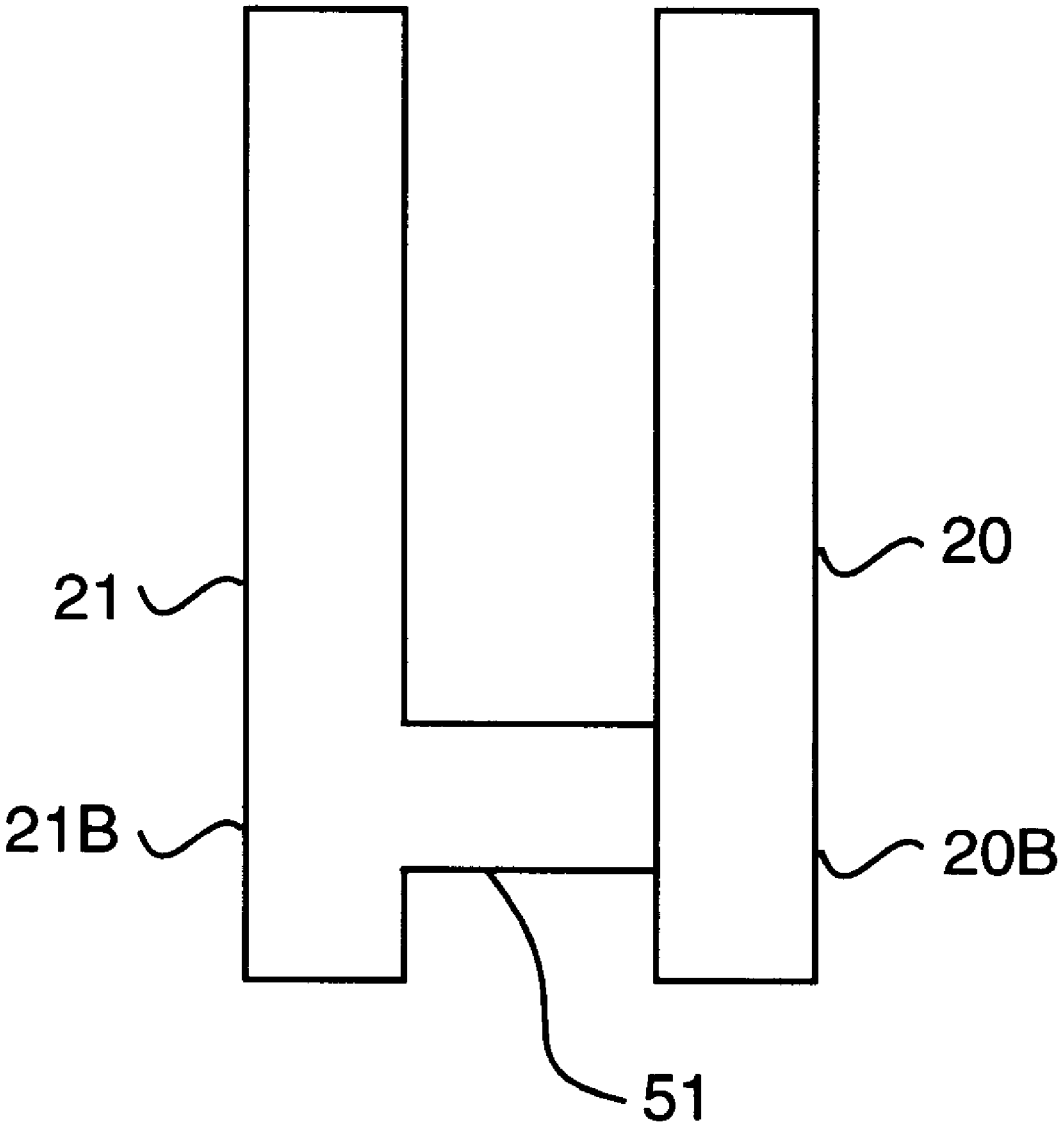
FIG. 8 is a partial cross-sectional view of the left and right coin chute walls taken along lines 8—8 of FIG. 5.

The inner surfaces 21C and 20C of the left and right coin chute walls, respectively, like the inner surfaces of the coin chute walls in the '673 patent, have grooves 60 and ribs 61 formed therein which are parallel to the direction of coin travel, as shown in FIGS. 5–7 of the drawings appended hereto. These grooves and ribs prevent wet or damp coins from sticking to the inner surfaces of the chute walls. Also, groove blocks 62, like those disclosed on the '673 patent, are disposed in the grooves to block parts of the spaces between the ribs. The groove blocks, together with the zig-zag configuration of the right and left chute walls, will block a wire or similar foreign object from being forced by a thief far into the coin chute path.

In the event that a thief has successfully stuffed a foreign object, such as, for example, a wad of paper, through the coin slot 2 and shutter slot 22A and into the coin chute path, it is the thief's hope that a subsequent user will deposit coins through the same slots and that the coins would be trapped in the coin chute path by the foreign material. It is also the thief's hope that the subsequent user's attempts to retrieve the coins by rotating the coin return lever 4 would be unsuccessful and that the thief could, after the subsequent user has left, fish the coins out by using a bent wire or other tool.

The improved coin receiving mechanism described above thwarts the thief's plans because when the subsequent user rotates the coin return lever of a pay telephone comprising the improved coin receiving mechanism, both the trapped coins and the stuffing material are released and the coins are deposited into a coin return chute which the legitimate customer accesses through coin return door 5.

Further in this regard, when coin return lever 4 is rotated by a user, the left end of actuating lever moves upward and pushes against roller 24. Roller 24 in turn moves out of its unactivated state and rolls up along actuating lever 25, and as the roller is doing that, roller bracket 23, shutter 22 and left chute wall 21 all pivot clockwise as viewed from the front. The shutter slot at this point moves out of alignment with coin slot 2 so that a user cannot deposit a coin into the machine when the left chute wall (and the shutter fixedly attached to it) are moved in the clockwise direction.

The right coin chute wall, which like the left coin chute wall is pivotally or hingedly mounted on the frame through the wall shaft 19, is caused by the force exerted by leaf spring 17 to follow along with the left coin chute wall as the left coin chute wall moves through approximately the first 10% to 15% of its clockwise rotation. At this point, the lower portion of the inside surface of the right chute wall is disposed over the left hopper or exit ramp 17, and the inner surfaces of the left and right chute walls are still parallel to each other. Whereas the lower portions of the coin chute walls were previously in communicating relationship with the exit area (i.e., coins would pass from between the lower portions of the coin chute walls into the hopper or exit area), they now are no longer in such a communicating relationship. Foreign material trapped between the left and right chute walls is not released prior to this point, and as a result, none of the foreign material is dropped into the hopper or exit (or into the mouth of the coin acceptor/counter 28).

As actuating lever 25 is rotated clockwise so as to rotate the left chute wall further in the clockwise direction, the right chute wall ceases following the left chute wall. That is because, as the right chute wall had earlier rotated clockwise with the left chute wall, rocker actuator 13 caused rocker 26 to rotate counterclockwise when viewed from the front until the lower end of the rocker comes into contact with the right hopper or exit ramp 12. The rocker of the improved coin receiving mechanism is configured so that this happens when the lower portion of the inside surface of the right chute wall has been moved to the position over left hopper ramp 17. At this point, the force exerted by leaf spring 17 is not sufficient to move the rear eject door 38, to which right hopper ramp 12 is fixedly attached, particularly against the force exerted by springed hinge 39.

As the left coin chute wall continues to rotate in the clockwise direction without the right coin chute wall following it, the inner surface of the left chute wall is moved apart from the inner surface of the right chute wall. The two chute walls move apart from each other much the same as the jaws of a pair of pliers open up relative to each other.

When this occurs, foreign material previously trapped between the left and right chute walls, along with any coins trapped along with the foreign materials are released and fall into the interior of the pay telephone's case.

Such foreign material and coins are prevented from falling into the hopper area (and then into the mouth of the coin accepter/counter device) by two means. The foreign material and coins which had been trapped in the coin chute path defined by the lower and rear portions of the left and right chute walls are blocked from the hopper area by the left chute wall which has been moved into position over the left hopper ramp, and foreign material and coins which had been trapped in the coin chute path defined by the upper portion of the left and right chute walls are deflected away from the hopper area by ejector lip 44, which extends out above and further to the left than the left hopper ramp. As described in the '673 patent, the released foreign materials and coins fall into a receptacle hung in the case, which receptacle has a chute which conveys the foreign material and coins to coin return slot accessible through coin return door 5.

As actuating lever 25 is pivoted further clockwise, the left chute wall continues to pivot clockwise and the opening between the left and right chute doors continues to widen until the left chute wall has moved through about 70% to 80% of its rotation. At this point, all foreign material previously trapped between the two chute walls is released Also, at this point, shutter bracket 22B comes into abutting relationship with rocker regulative screw 15 which is screwed into rocker actuator 13. As actuating lever 25 is pivoted even further clockwise so that left chute wall 21 is caused to rotate clockwise through the last 20% to 30% of its rotation, sufficient force must be exerted by the user to overcome the force of the springed hinge. When this is done, right chute wall 20 once again follows the left chute wall as a result of the shutter bracket pulling against the rocker regulative screw. The height of the regulative screw is adjusted to allow the left and right chute wall to open sufficiently for foreign materials to be ejected from between the coin chute walls. As the right chute wall rotates clockwise, the rocker actuator causes the rocker to rotate further counterclockwise, and the rocker's lower end pushes against the right hopper or exit ramp. This in turn forces the rear door 38 of the coin acceptor/counter device 28 to open, and any foreign material and bent coins which happened to make their way into the mouth of the coin acceptor/counter device to be ejected therefrom and into the debris receptacle.

The clockwise rotation of the left and right walls is stopped by the left side of rocker 26 coming into contact with the right side of chute ceiling 34.

When the coin return lever is released by the user, the forces exerted by the springed hinge 39 (by which eject door 38 is attached to the main body of the coin acceptor/counter 28) and spring 18 cause all the moved parts to return to their normal positions.

It should be noted that when a thief stuffs foreign material into the space between the left and right chute walls, this may cause the left chute wall to move apart from the right chute wall. Since the right chute wall cannot rotate in the counterclockwise direction from its normal position, and since the left chute wall is not rigidly mechanically linked to the right chute wall until the left chute wall has moved through 70% to 80% of its rotation, the left chute wall may be caused to rotate in the clockwise direction by the stuffing. This results in the shutter slot being moved out of alignment with the coin slot, and the thief's plans are spoiled from the beginning.

In the event a thief attempts to use a wire to move foreign material down into the lower portions of the coin chute path and such thief is successful in maneuvering past the grove blocks in the upper portion of the path, the thief will still be thwarted by the lack of a rigid back wall. Instead, the thief's foreign material and wire will pass right out the back of the chute walls and will push open rear door 16. When the thief tries to withdraw the wire, the foreign material will be swept of the wire and fall into the debris receptacle. The door will close again under the force of spring 16A.

The drawings and foregoing description are not intended to represent the only form of the invention in regard to the details of its construction and manner of operation. In fact, it will be evident to one skilled in the art that modifications and variations may be made without departure from the spirit and scope of the invention. For example, mirror images of the above-described elements may be used, and references to front and back, left and right, and clockwise and counterclockwise may be reversed. Changes in form and in proportions of parts, as well as the substance of equivalents are contemplated as circumstances may suggest or render expedient. Although specific terms have been employed, they are intended in a generic and descriptive sense only and not for the purpose of limitation, the scope of the invention being detailed in the following claims:

The invention is claimed as follows:

1. A coin receiving mechanism having a foreign object release device for use with a coin receiving machine, said mechanism comprising:

(a) first and second chute walls having spaced apart inner surfaces which are substantially parallel to each other when said mechanism is in an unactivated state and wherein said inner surfaces define left and right walls of a coin chute path through which a coin travels, said first and second chute walls each further having an upper chute wall portion and a lower chute wall portion, wherein said upper chute wall portion is disposed adjacent an entrance to said coin chute path and wherein said lower chute wall portion is disposed adjacent to and in communicating relationship with an exit of the coin chute path;

(b) a frame onto which said left and right chute walls are hingedly mounted;

(c) an actuating lever having a first end pivotally mounted to said frame and a second end disposed opposite thereto;

(d) a roller rotatably mounted on a roller bracket which is fixedly attached to said first coin chute wall, wherein said roller is disposed upon an upper actuating lever surface of said actuating lever, wherein when said actuating lever is not activated, said coin chute walls remain in said unactivated state, and wherein when said actuating lever is caused to pivot in a clockwise direction, with the second end of the actuating lever moving upward, said roller is caused to ride up on the upper actuating lever surface toward said second end of said actuating lever, and in turn said first coin chute wall is caused to pivot in said clockwise direction to an activated state; and (e) a first spring member disposed between said second chute wall and said frame, said first spring member causing said second chute wall to pivot in said clockwise direction with said first chute wall until, but not substantially further than, a position in which said lower chute portions of the first and second chute are no longer in communicating relationship with said exit of said coin chute path, and wherein said first coin chute wall may continue to move in said clockwise direction beyond said position in which said lower chute portions are no longer in communicating relationship with said exit so that the coin chute walls open to eject foreign objects caught between said coin chute walls and thereby clear said coin chute path while restricting said objects from falling into said exit.

2. The coin receiving mechanism of claim 1, further comprising a second spring member disposed between said frame and said first coin chute wall, said second spring member causing said first and second chute walls, said roller, said roller bracket and said actuating lever to return to their respective unactivated positions when said actuating lever is released by a user of the coin receiving mechanism.

3. The coin receiving mechanism of claim 2, further comprising a rocker actuator fixedly mounted to said second coin chute wall, a rocker rotatably mounted about a shaft on said frame, said rocker having an upper end and pivotally engaged with said rocker actuator and a lower end which is adjacent to an exit ramp fixedly attached to an eject door of said coin accepter/counter device, and wherein said lower end of said rocker is not in contact with said exit ramp until said second coin chute is pivoted in a clockwise direction until said first and second chute walls are no longer in communicating relationship with said exit.

4. The coin receiving mechanism of claim 3 wherein said eject door is mounted to the coin accepter/counter device's main body by a spring hinge and wherein said spring hinge urges said door toward a closed position.

5. The coin receiving mechanism of claim 4 wherein said roller bracket is also fixedly attached to a shutter and wherein said shutter has a shutter bracket which engages said rocker actuator after said coin chute walls have opened, whereby as said actuating lever is continued to be moved in said clockwise direction, the second chute wall is caused to move further in the clockwise direction, the rocker actuator causes the rocker to rotate further in the counterclockwise direction, the lower end of said rocker to push against said exit ramp and to open said eject door.

* * * * *